US006073707A

United States Patent [19]

Noe et al.

[11] Patent Number: 6,073,707

[45] Date of Patent: Jun. 13, 2000

[54] DOWNHOLE SUB WITH KICK PAD FOR DIRECTIONAL DRILLING

[75] Inventors: Paul Noe, Sugarland, Tex.; David Kutinsky, Edmonton, Canada

[73] Assignee: Canadian Downhole Drill Systems Inc., Nisku, Canada

[21] Appl. No.: 09/057,709

[22] Filed: Apr. 9, 1998

[30] Foreign Application Priority Data

Mar. 11, 1998 [CA] Canada ..... 2231922

[51] Int. Cl.[7] ..... E21B 7/04

[52] U.S. Cl. ..... 175/74; 175/76

[58] Field of Search ..... 175/61, 62, 73, 175/74, 75, 76

[56] References Cited

U.S. PATENT DOCUMENTS

| | | | |
|---|---|---|---|
| Re. 33,751 | 11/1991 | Geczy et al. | 175/61 |
| 3,306,378 | 2/1967 | Williams, Jr. | 175/76 |
| 4,606,417 | 8/1986 | Webb et al. | 175/76 |
| 4,638,873 | 1/1987 | Welborn | 175/73 |
| 4,745,982 | 5/1988 | Wenzel | 175/74 |
| 4,813,497 | 3/1989 | Wenzel | 175/74 |
| 4,884,643 | 12/1989 | Wawrzynowski et al. | 175/74 |
| 4,932,482 | 6/1990 | DeLucia | 175/75 |
| 4,962,818 | 10/1990 | DeLucia | 175/75 |
| 4,991,668 | 2/1991 | Rehm et al. | 175/61 |
| 5,029,654 | 7/1991 | Wilson et al. | 175/74 |
| 5,065,826 | 11/1991 | Kruger et al. | 175/75 |
| 5,090,496 | 2/1992 | Walker | 175/61 |
| 5,125,463 | 6/1992 | Livingstone et al. | 175/74 |
| 5,343,966 | 9/1994 | Wenzel et al. | 175/74 |
| 5,368,111 | 11/1994 | Benoit et al. | 175/74 |
| 5,423,389 | 6/1995 | Warren et al. | 175/75 |
| 5,441,119 | 8/1995 | Head | 175/74 |
| 5,474,334 | 12/1995 | Eppink | 285/184 |
| 5,495,901 | 3/1996 | Livingstone et al. | 175/74 |
| 5,638,910 | 6/1997 | Noe et al. | 175/73 |
| 5,836,406 | 11/1998 | Schuh | 175/61 |

*Primary Examiner*—Frank Tsay
*Attorney, Agent, or Firm*—Christensen O'Connor Johnson & Kindness PLLC

[57] ABSTRACT

A downhole drill system comprising a drill string, a drill bit terminating the drill string, a bent sub in the drill string above the drill bit, a motor housing in the drill string above the drill bit and a downhole sub connected within the drill string to the motor housing. The downhole sub comprises an adaptor housing in the drill string above the motor housing, a mandrel connected to the adaptor housing, the mandrel having a shoulder facing the adaptor housing, the mandrel shoulder and the adaptor housing together forming an annular recess, a kick pad mounted for rotation in the annular recess and movable around the annular recess when the mandrel is disengaged from the adaptor housing and a lock mechanism for locking the kick pad in a fixed position relative to the adaptor housing when the mandrel is engaged with the adaptor housing.

2 Claims, 3 Drawing Sheets

DOWNHOLE SUB WITH KICK PAD FOR DIRECTIONAL DRILLING

FIELD OF THE INVENTION

This invention relates to downhole subs used in directional drilling, particularly in the drilling of oil and gas wells.

BACKGROUND OF THE INVENTION

A bent sub is often used in conjunction with a downhole motor and a drill bit in a drill string to build a predetermined angle of a borehole and thus allow for directional drilling. The bent sub provides a bend in the drill string above the drill bit. By orienting the bent sub in a selected bend direction, and choosing a bent sub with a selected bend, the drill bit will advance in the bend direction an amount determined largely by the selected bend. Various prior art bent subs are known, as for example U.S. Pat. No. 5,029,654 of Wilson et al, U.S. Pat. No. 5,125,463 of Livingstone et al, U.S. Pat. No. 5,343,966 of Wenzel et al and U.S. Pat. No. 4,667,751 of Geczy et al.

In the prior art, various techniques are used to establish the location of the drill bit in the borehole. For example, U.S. Pat. No. 4,667,751 describes a technique using a system of concentric stabilizers. In addition, it is known to use weld on kick pads on the drill string above the bent sub to kick the drill string over to one side of the borehole and allow build on the opposite side. However, these prior art techniques have disadvantages, such as difficulty in passing an enlarged area in a blow out preventor or, in the case of the weld on kick pads, potentially causing damage to the drill string during welding.

The inventors have provided an improved downhole sub for use with a bent sub in U.S. Pat. No. 5,638,910 issued on Jun. 17, 1997. The downhole sub includes upper and lower tubular sections whose centers are offset from one another in the bend direction of the bent sub. The downhole sub includes an intermediate tubular section disposed between the upper and lower tubular sections, with the bore of the intermediate section included within overlap between extensions of each of the bores of the upper and lower tubular sections. The axes of the upper and lower tubular section are parallel and offset between about ¼ inch and 2 inches. The intermediate section grades gradually into the upper and lower tubular sections. The downhole sub is used by incorporation into a drill string above the bent sub and spaced from the bend sufficiently to allow the drill string to use the downhole sub as a lever to force the drill bit into the wall of the borehole.

SUMMARY OF THE INVENTION

In the downhole sub shown in U.S. Pat. No. 5,638,910, the downhole sub must be properly oriented to the bent sub, and this is not easily done in the field. The present invention provides a readily orientable sub for use in forcing the drill bit into the wall of a borehole during directional drilling.

There is therefore provided in accordance with an aspect of the invention, a downhole drill system comprising a drill string, a drill bit terminating the drill string, a bent sub in the drill string above the drill bit, a motor housing in the drill string above the drill bit and a downhole sub connected within the drill string to the motor housing. The downhole sub comprises an adaptor housing in the drill string above the motor housing, a mandrel connected to the adaptor housing, the mandrel having a shoulder facing the adaptor housing, the mandrel shoulder and the adaptor housing together forming an annular recess, a kick pad mounted for rotation in the annular recess and movable around the annular recess when the mandrel is disengaged from the adaptor housing and a lock mechanism for locking the kick pad in a fixed position relative to the adaptor housing when the mandrel is engaged with the adaptor housing.

These and further aspects of the invention are described in more detail in the detailed description and claimed in the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
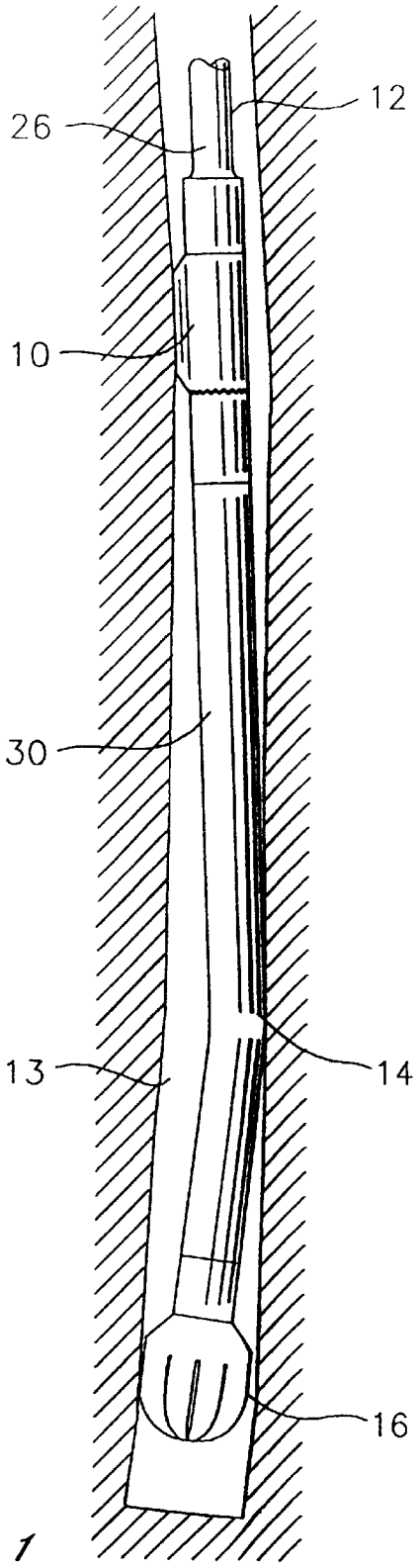
FIG. 1 is a schematic showing an embodiment of the invention including drill bit, bent sub and downhole sub in a well bore.
Figure 2:
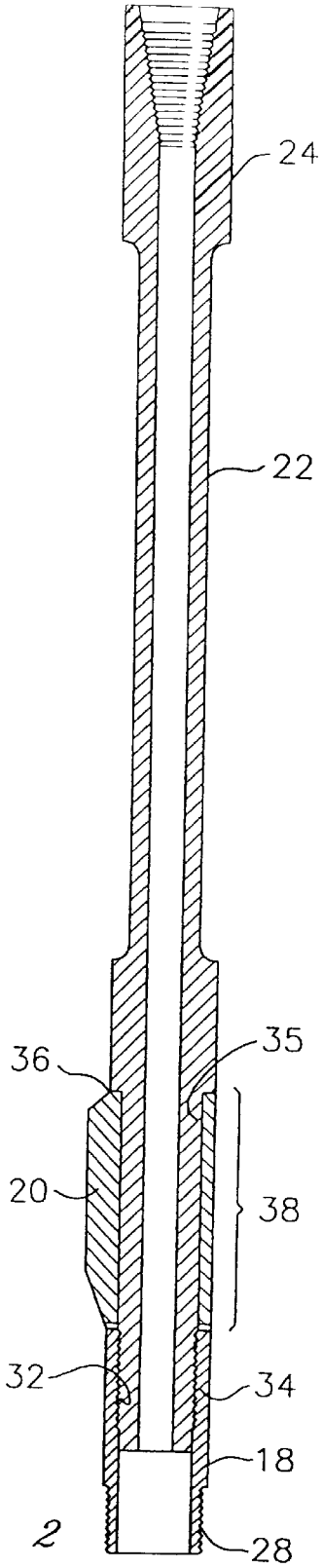
FIG. 2 is a section through a downhole sub according to the invention, showing adaptor housing, kick pad and mandrel.

Referring to FIG. 1, there is shown a downhole drill system formed of a downhole sub 10 in a drill string 12 above a bent sub 14 and drill bit 16 terminating the drill string 12 below the bent sub. The drill string 12 is located in a borehole 13. Apart from the downhole sub 10, the drill string 12 is a conventional bent sub downhole motor assembly. The bent sub 14 is bent in a bend direction (parallel to the plane of FIG. 1). Referring to FIG. 2, the downhole sub 10 is formed of a tubular adaptor housing 18, kick pad 20 and tubular mandrel 22. Mandrel 22 is threaded at one uphole end 24 for connection to an upper portion 26 of drill string 12. Adaptor housing 18 is threaded at downhole end 28 for connection to a lower portion 30 of the drill string 12 containing a mud motor or like device. For example, the lower portion 30 is conveniently a stator or motor housing of the mud motor. The mud motor is conveniently located above the bend of the bent sub but may be below the bend of the bent sub or the bend may be incorporated within the mud motor.

Referring to FIG. 2, the mandrel 22 is connected by cooperating threaded sections 32 and 34 to the adaptor housing 18. The mandrel 22 has a shoulder 36 on its downhole end facing the adaptor housing 18. The mandrel shoulder 36 and the adaptor housing together define axial boundaries of an annular recess 38 on the mandrel 22. The kick pad 20 is mounted for rotation in the annular recess 38 and is movable around the annular recess 38 when the mandrel 22 is disengaged from the adaptor housing 18. Optionally, the reduced diameter portion 35 of the mandrel 22 may be formed as an integral extension of the adaptor housing 18 which is threaded into threads on the mandrel 22 at the shoulder 36. Further, the reduced diameter portion 35 of the mandrel 22 may be formed as extensions of both the mandrel 22 and the adaptor housing 18, with a joint in the middle of the recess 38.

Figure 4:
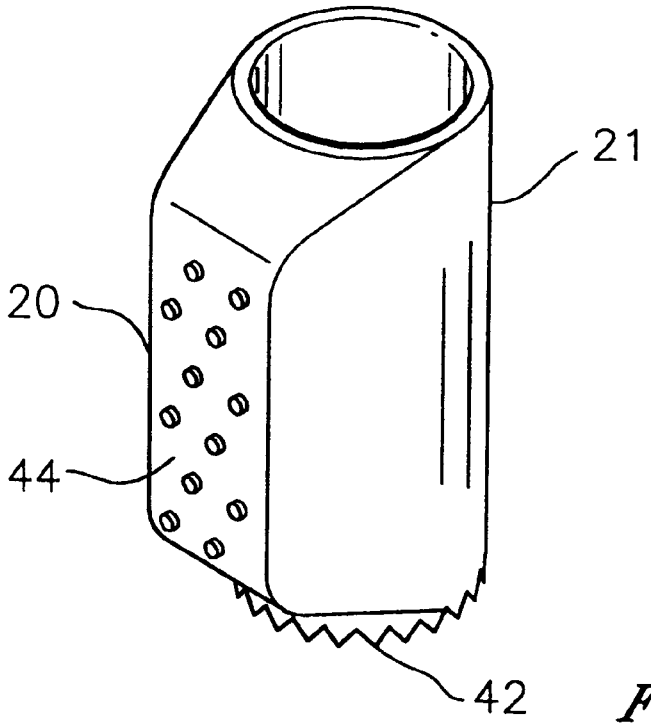
FIG. 4 is a perspective of a kick pad for use in the downhole sub shown in FIG. 2.

Referring to FIG. 4, the kick pad 20 is formed of a tubular body 21 on one side of which is an enlargement or pad 44 that extends on one side of the kick pad beyond the diameter of the adaptor housing 18 or mandrel 22 a sufficient amount to affect the positioning of the drill bit and drive the drill bit into the borehole. The outer surface of the pad 44 may include wear resistant buttons or similar features to assist in preventing wear.

Figure 3:
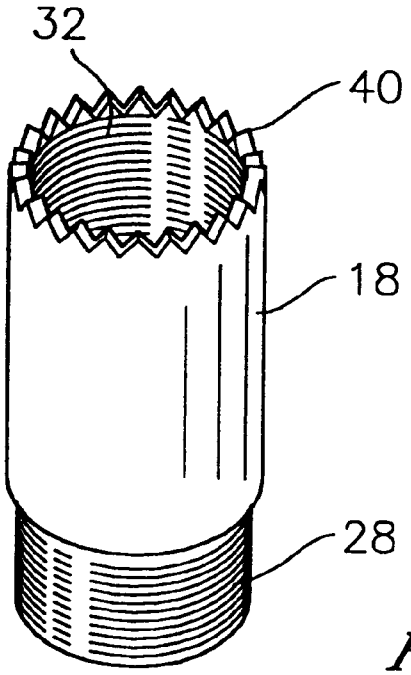
FIG. 3 is a perspective of an adaptor housing for use in the downhole sub shown in FIG. 2.

Referring to FIG. 3, the adaptor housing 18 has teeth 40 formed on its uphole locking face that defines the lower boundary of the annular recess 38. The kick pad 20 has teeth 42 formed on its downhole face that may engage and lock with the teeth 40 on the adaptor housing. Together, the teeth 40 and 42 form a lock mechanism for locking the kick pad 20 in a fixed position relative to the adaptor housing 18 when the mandrel 22 is engaged with the adaptor housing 18.

Figure 5:
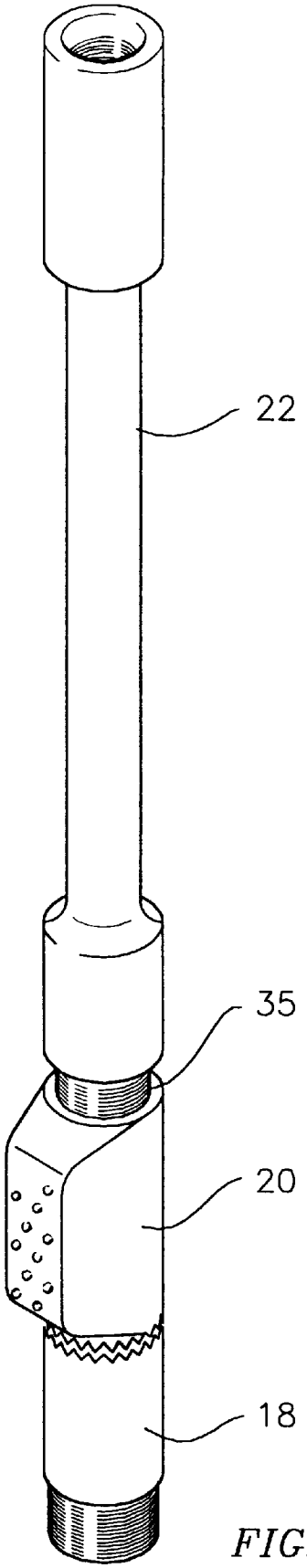
FIG. 5 is a perspective view of the downhole sub of FIG. 2 with the mandrel backed out of the adaptor housing.
Figure 6:
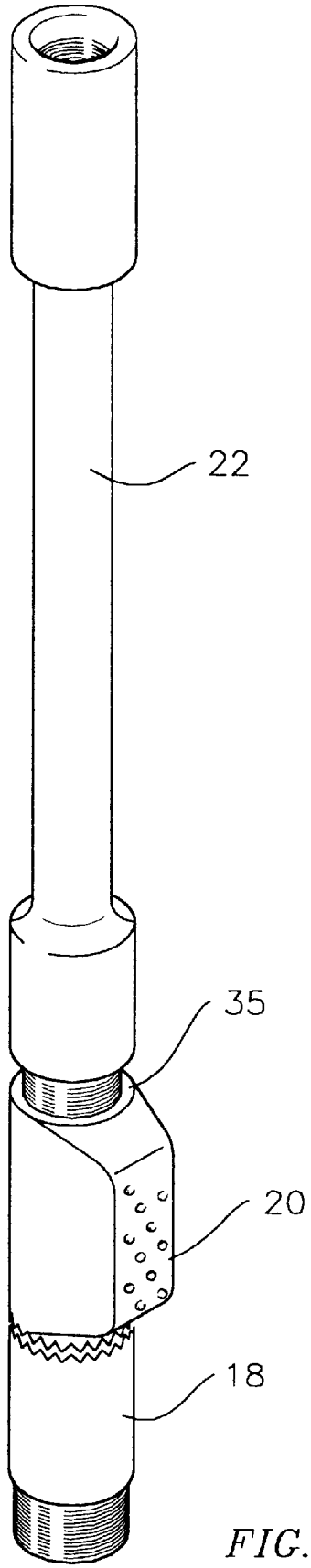
FIG. 6 is perspective view of the downhole sub of FIG. 2 with the kick pad oriented in proper position ready for screwing the mandrel back into the adaptor housing.

The operation of the downhole sub of the invention is best appreciated by reference to FIGS. 1, 5 and 6. First, the downhole sub 10 is assembled as shown in FIG. 2 in the drill system shown in FIG. 1, with the adaptor housing 18 threaded into the stator of the mud motor. The bend in the conventional bent sub is then set to the desired amount according to conventional methods. Next, as shown in FIG. 5, the mandrel 22 is backed off, out of the adaptor housing 18. Backing off the mandrel 22 effectively enlarges the annular recess 38 and the kick pad 20 may be moved longitudinally along the recess towards the shoulder 36 on the mandrel 22. Moving the kick pad 20 away from the adaptor housing 18 disengages teeth 40 and 42. The kick pad 20 may now be rotated within the annular recess 38 to the desired position shown in FIG. 6. The kick pad 20 is moved towards the adaptor housing 18 to engage the teeth 40 and 42 and lock the kick pad 20 in the desired position in relation to the bend direction of the bent sub.

A person skilled in the art could make immaterial modifications to the invention described and claimed in this patent without departing from the essence of the invention.

The embodiments of the invention in which an exclusive property or privilege is claimed are defined as follows:

1. A downhole drill system comprising:

a drill string;

a drill bit terminating the drill string;

a bent sub in the drill string above the drill bit;

a motor housing in the drill string above the drill bit;

an adaptor housing in the drill string above the motor housing;

a mandrel connected to the adaptor housing, the mandrel having a shoulder facing the adaptor housing, the mandrel shoulder and the adaptor housing together forming axial boundaries of an annular recess;

a kick pad mounted for rotation in the annular recess and movable around the annular recess when the mandrel is disengaged from the adaptor housing; and a lock mechanism for locking the kick pad in a fixed position relative to the adaptor housing when the mandrel is engaged with the adaptor housing.

2. A downhole sub, comprising:

an adaptor housing having a drill string connector at one end;

a mandrel connected to the adaptor housing at an end of the adaptor housing opposed to the drill string connector end, the mandrel having a shoulder facing the adaptor housing, the mandrel shoulder and the adaptor housing together forming axial boundaries of an annular recess;

a kick pad mounted for rotation in the annular recess and movable around the annular recess when the mandrel is disengaged from the adaptor housing; and a lock mechanism for locking the kick pad in a fixed position relative to the adaptor housing when the mandrel is engaged with the adaptor housing.

* * * * *